US008766121B2

(12) United States Patent
Mahida et al.

(10) Patent No.: US 8,766,121 B2
(45) Date of Patent: Jul. 1, 2014

(54) ROTARY CONTROL SWITCH

(75) Inventors: Dharmendrasinh R. Mahida, Sunrise, FL (US); Peter B. Gilmore, Plantation, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 329 days.

(21) Appl. No.: 13/117,107

(22) Filed: May 26, 2011

(65) Prior Publication Data

US 2012/0298494 A1 Nov. 29, 2012

(51) Int. Cl.

| | |
|---|---|
| ***H01H 3/08*** | (2006.01) |
| ***H01H 19/00*** | (2006.01) |
| ***H01H 19/14*** | (2006.01) |
| ***H01H 21/00*** | (2006.01) |
| ***G05G 5/06*** | (2006.01) |
| ***H01H 3/02*** | (2006.01) |
| ***H01C 10/36*** | (2006.01) |
| ***H01H 19/11*** | (2006.01) |

(52) U.S. Cl.

CPC ..... *H01H 19/115* (2013.01); *G05G 5/06* (2013.01); *H01H 3/08* (2013.01); *H01H 3/0213* (2013.01); *H01C 10/36* (2013.01); *H01C 10/363* (2013.01)

USPC ..... 200/336

(58) Field of Classification Search

USPC ..... 200/336, 329, 179, 19.03–19.05, 19.07, 200/19.08, 19.18–19.19, 36, 35 H, 316, 521

See application file for complete search history.

(56) References Cited

U.S. PATENT DOCUMENTS

| | | | | |
|---|---|---|---|---|
| 5,223,822 | A * | 6/1993 | Stommes et al. | 137/551 |
| 5,939,973 | A | 8/1999 | Imamura | |
| 5,954,192 | A * | 9/1999 | Iitsuka | 200/336 |
| 8,076,603 | B2 * | 12/2011 | Huang et al. | 200/566 |
| 8,220,361 | B2 * | 7/2012 | Slavin et al. | 74/553 |
| 2004/0245080 | A1 * | 12/2004 | Turner | 200/329 |
| 2010/0000846 | A1 * | 1/2010 | Nemetz | 200/336 |
| 2012/0000758 | A1 * | 1/2012 | Fukushima et al. | 200/337 |

FOREIGN PATENT DOCUMENTS

| | | | |
|---|---|---|---|
| DE | 1665217 | A1 | 3/1971 |
| EP | 1489631 | A2 | 12/2004 |
| EP | 1564770 | A2 | 8/2005 |

(Continued)

OTHER PUBLICATIONS

International Search Report and Written Opinion for related counterpart International Patent Application No. PCT/US20112/038597 mailed on Nov. 29, 2012.

*Primary Examiner* — Edwin A. Leon
*Assistant Examiner* — Anthony R. Jimenez
(74) *Attorney, Agent, or Firm* — Barbara R. Doutre; Daniel R. Bestor

(57) ABSTRACT

A rotary on/off control switch (100, 700, 900) provides improved torque with single click operation. Rotary on/off control switch (100) is formed of a casing (106), a drive member (108), and a carrier member (110) having frictional elements (112) coupled thereto. A lever (116) and drive member (108) provide rotation of the carrier within the casing. In response to rotation of the drive member (108), carrier member (110) and lever (116), each frictional element (112) travels against the casing generating torque for single click ON operation. Rotation past a predetermined angle causes the carrier member (110) to remain stationary for variable function control of the rotary on/off control switch (100). Reverse rotation of the drive member (108), carrier member (110) and lever (116), generates torque for single click OFF operation.

21 Claims, 12 Drawing Sheets

(56) References Cited

FOREIGN PATENT DOCUMENTS

| | | | |
|---|---|---|---|
| GB | 1147674 | A | 4/1969 |
| WO | 2010092910 | A1 | 8/2010 |
| WO | 2010106891 | A1 | 9/2010 |
| WO | 2011096118 | A1 | 11/2011 |

* cited by examiner

DRIVE PIN COUPLED 0°

DRIVE PIN DECOUPLING 40°

DRIVE PIN DECOUPLED > 40°

DRIVE PIN DECOUPLED

DRIVE PIN DECOUPLED 180°

DRIVE PIN HITTING STOP FEATURE > 180°

ROTARY CONTROL SWITCH

FIELD OF THE INVENTION

The present invention relates generally to rotary switches and more particularly to rotary switches for a communication device.

BACKGROUND

Rotary on/off switches are used in a variety of communication devices to provide a user interface for controlling operational functions such as power on/off, volume, and channel change, to name a few. For power on/off applications, the rotary switch may be designed to provide tactile feedback in the form of a click, or snap, to indicate that the switch has turned on or off. The switch may further provide a certain amount of torque, or frictional resistance, as the switch is rotated.

The tactile feedback provided by a rotary on/off switch is particularly important for portable communication devices operating within a public safety environment. For example, in public safety environments involving fire rescue, paramedic and/or law enforcement, a handheld radio may be operated by a user wearing heavy gloves, working in an area with little or no illumination, or other environmental or physical condition that necessitates a simple, easy to interpret user interface. As such, in the public safety arena, a communication device that offers a "single-click" feedback is often required. However, several design challenges are associated with the implementation of a single-click rotary on/off switch.

Certain rotary switches, such as those utilized in public safety applications, are designed to operate over a rotation range greater than 180 degrees. While the greater than 180 degree rotation provides more range with which to control such functions as volume, the single click is still required for public safety applications. To generate the single click, the rotary switch is typically limited to a single detent (bump). However the single detent presents additional implementation issues as discussed below.

A problem associated with the single click on/off switch is limited torque capacity. Rotary on/off switches which are required to rotate more than 180 degrees are limited, as previously discussed, by the single detent. The torque generating capacity of the single detent switch is fundamentally limited as a single detent provides less friction, and ultimately results in low torque.

Another problem associated with current day on/off rotary switches is the propensity for an unbalanced condition. Rotary on/off switches which are required to rotate more than 180 degrees are limited by the single detent as discussed above. When actuating the single click switch, the single detent results in unbalanced forces. These unbalanced forces make the implementation of such a switch very sensitive to spatial clearance limitations. The unbalanced design may potentially cause high stresses and moments on internal switch components.

Hence, the challenges of designing a rotary on/off switch for single click applications include single detent limitations, limited torque capacity and unbalanced design conditions.

Accordingly, there is a need for an improved on/off rotary switch which can overcome the aforementioned problems.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
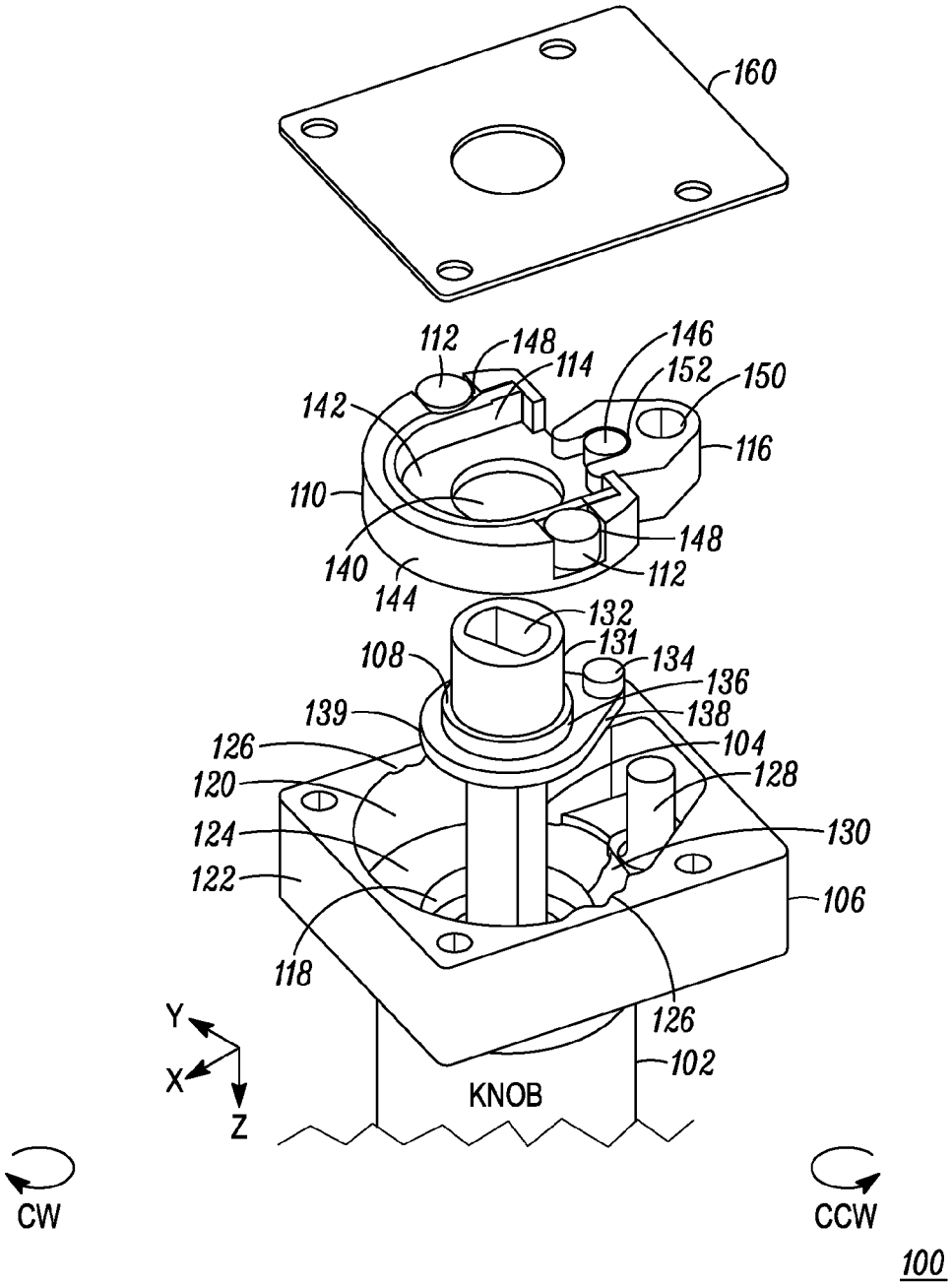
FIG. 1 is a first partially exploded view illustrating a rotary on/off control switch in accordance with a first embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in apparatus components related to a rotary on/off control switch assembly. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the elements.

Figure 2:
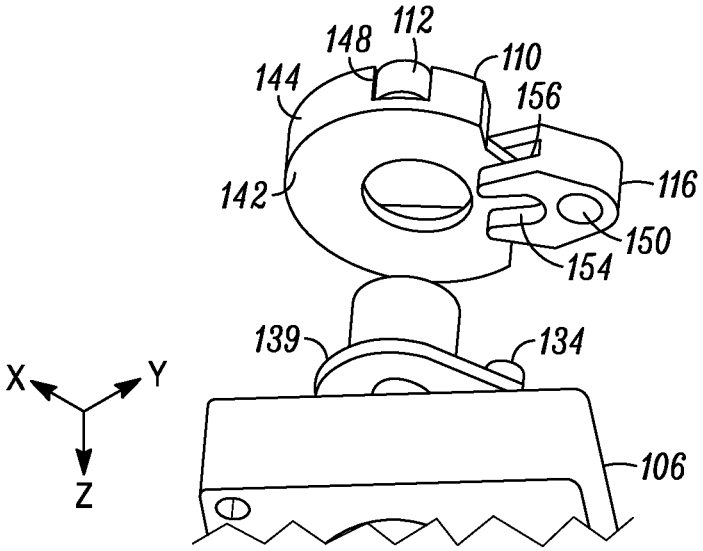
FIG. 2 is a second partially exploded view illustrating the rotary on/off control switch of FIG. 1 in accordance with the first embodiment.
Figure 3:
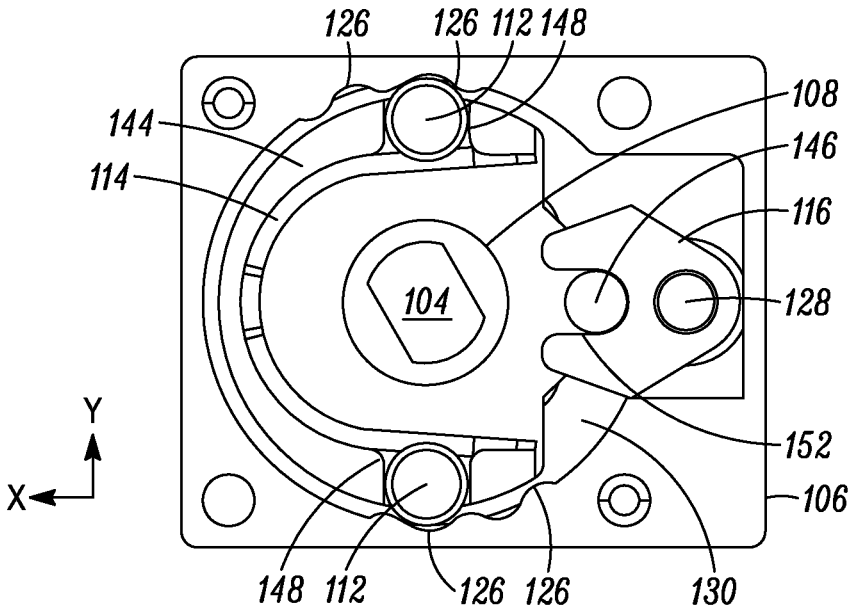
FIG. 3 is a top assembled view illustrating the rotary on/off control switch of FIG. 1 in accordance with the first embodiment.
Figure 4:
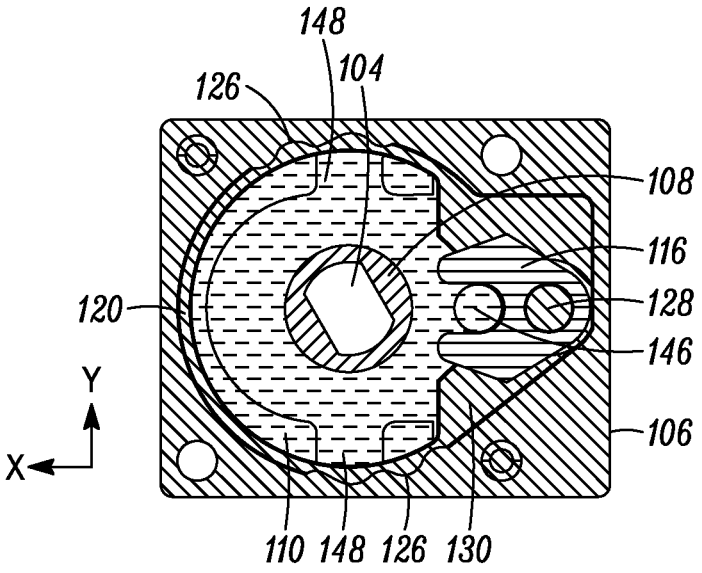
FIG. 4 is the top partially assembled view illustrating the rotary on/off control switch of FIG. 3 in accordance with the first embodiment.

FIGS. 1 and 2 show first and second partially exploded assemblies of a rotary on/off control switch 100 in accordance with a first embodiment. FIG. 3 shows an assembled top view illustrating the rotary on/off control switch of FIG. 1. FIG. 4 shows a partially assembled top view illustrating the rotary on/off control switch of FIG. 1. Referring to FIGS. 1-4, rotary on/off control switch 100 is formed of a plurality of assembly components comprising: a knob 102, a shaft 104, a casing 106, a drive member 108, a carrier member 110, a plurality of frictional elements 112, a compliant member 114, and a lever 116. Each component and its inter-assembly to other components will be described in detail herein.

Referring to FIG. 1, the shaft 104 is coupled to and extends from the knob 102. The casing 106 is formed of side walls 122 and a base 124, the base having a hole 118 through which the shaft 104 extends. The casing 106 includes an interior side surface forming a recessed area 120 about the hole 118 for receiving the plurality of assembly components. A plurality of detent features 126 are integrated along the interior side surface of recessed area 120 of casing 106. A bushing pin 128 and stop feature 130, also shown in FIG. 4, are integrated on the base 124 of casing 106. The casing 106 may be enclosed using a plate 160 which leaves access to the shaft 104.

Referring to FIG. 1, the drive member 108 can be slid down the shaft 104 so as to be seated within the recessed area 120 of the casing 106. In accordance with an embodiment, the drive member 108 is a unitarily molded piece part comprising a column portion 131 having an aperture 132 extending therethrough, a driver step or collar 136 formed at the base of the column portion 131, and a driver base 139 extending into a tab 138 having a drive pin 134 situated thereon. The shaft 104 is insertable through the aperture 132 of drive member 108. The drive pin 134 is rotatable in response to rotation of the knob 102 and shaft 104. In accordance with an embodiment, the rotation of the drive pin 134 is limited to a predetermined rotation range by the stop feature 130 of the casing 106. The stop feature 130 integrated within the casing has two sides with which to stop rotation of the shaft 104 and drive member 108 at an angle of zero degrees and an angle greater than 180 degrees.

In accordance with an embodiment, the fit between the shaft 104 and the aperture 132 of drive member 108 has a predetermined rotational clearance, also referred to as "rotational slop". The rotational clearance prevents the fit between the shaft 104 and drive member 108 from being too tight or too loose. A fit which is too tight would prevent the generation of a click, and a fit which is too loose would cause irregular tactile feedback which the user might perceive as a loose knob. The predetermined clearance provides increased audible feedback and reduces the user's ability to "tease" the switch to hang between two positions such as on and off positions.

Referring to FIG. 1, the driver step 136 of drive member 108 is used to support carrier member 110. The carrier member 110 is a unitarily molded piece part comprising a carrier base 142 with rounded wall 144 extending therefrom, a carrier pin 146 seated on the carrier base 142, an aperture 140 formed in the carrier base, and a plurality of recessed carrier openings 148 formed within the rounded wall 144. When the carrier member 110 is inserted within the casing 106, column portion 131 of drive member 108 and shaft 104 extend through the carrier member aperture 140, and carrier member 110 rests upon driver step 136 of drive member 108. A gap of predetermined space, provided by the driver step 136, will thus be formed between the carrier base 142 and the driver base 139, to be discussed later.

As seen in FIGS. 1, 2 and 3, each frictional element of the plurality of frictional elements 112 is seated within one of the plurality of recessed carrier openings 148 of carrier member 110. The plurality of frictional elements 112 may be formed of any element that will provide friction as each element travels across respective detents 126, for example, rollers, balls, sheet metal protrusions or semi circular sliders to name a few. The compliant member 114 provides appropriate spring loading when loaded within the carrier member 110 against the rounded wall 144, such that when the carrier member is seated within the casing 106, each of the plurality of frictional elements 112 is pushed against each of the plurality of detent features 126 of the casing 106 with an appropriate spring load. The casing 106 having the plurality of detent features 126 provides a frictional/resistive surface which generates torque and a single click (snap) when used with the compliant member 114 under the appropriate spring load. Balanced forces result in response to the compliant member 114 loading the frictional elements against the plurality of detent features 126 of casing 106. At least two frictional elements are used in conjunction with corresponding detent features (i.e. two or more bumps per element).

Referring to FIGS. 1-4, the lever 116 comprises a lever hole 150 through which the bushing pin 128 of the casing 106 emerges. The lever 116 further comprises top and bottom lever portions having a top lever recess 152 and a bottom lever recess 154 forming a slot 156 therebetween, as seen in FIG. 2. The slot 156 of the lever 116 receives the carrier base 142, such that the top lever recess 152 engages the carrier pin 146 of the carrier member 110. The bottom lever recess 154 engages the drive pin 134 of the drive member 108. Thus, the gap formed by the driver step 136 between the carrier base 142 and the driver base 139 accommodates the bottom lever portion having bottom lever recess 154.

The top partially assembled view of FIG. 4 is shown with hatching to facilitate visualization of the unitarily molded piece parts—the compliant member 114 and plurality of frictional elements 112 have been omitted to more clearly show the recessed carrier openings 148 of carrier member 110. The shaft 104, drive member 108, casing 106, and carrier member 110 may be formed of suitable metals, such as stainless steel, aluminum, or brass to name a few and are preferably Metal Injection Molded (MIM) for Steel. This view also shows the stop feature 130 as formed within the base of the casing 106.

In operation, the drive member 108 can be rotated by the shaft 104 over a rotation range of greater than 180 degrees as set by stop feature 130. In operation, the lever 116 is rotated in response to the drive member 108 being initially rotated by the shaft 104 within a predetermined portion of the rotation range. The predetermined portion of the rotation range may be, for example, set between 0 to 40 degrees. Between this predetermined portion of the rotation range, the drive member 108 engages to and disengages from the bottom lever recess 154, while the top lever recess 152 engages the carrier pin 146 of the carrier member 110. The carrier member 110 is rotated in response to the lever 116 being rotated by drive member 108 over the predetermined range of rotation. The plurality of frictional elements 112 seated in the plurality of recessed carrier openings 148 on carrier member 110 rotate with the rotation of the carrier member. The plurality of frictional elements 112 are forced by compliant member 114 towards the plurality of detent features 126. Due to the rotation of carrier member 110, each frictional element will travel from one detent to the next generating torque and a single click. All frictional elements 112 travel simultaneously and thus provide the single click for indicating the switch has been turned ON.

Thus, the single click occurs between the predetermined portion of the rotation range (e.g. 0 to 40 degrees) as the shaft 104 transfers motion to the drive member 108, and the drive member 108 transfers motion to the lever 116, and the lever 116 transfers motion to the carrier member 110 such that frictional elements 112 travel across detent features 126 simultaneously. Rotation in a first direction, in this view counter clockwise (CCW) direction, takes the switch from OFF to ON generating the single click.

The single click provides an indication that the switch is turned from OFF to ON at the initiation of counter clockwise (CCW) rotation. Continuing with CCW rotation of the shaft 104 to a predetermined angle of rotation, for example at an angle of 40 about degrees, causes the drive pin 134 of drive member 108 to disengage from bottom lever recess 154 of lever 116. This event decouples shaft 104 rotations from carrier member 110 rotation, and as such, the plurality of frictional elements 112 seated within the recessed carrier openings 148 remain stationary. The remaining range of rotation available to the drive member 108 (from 40 degrees to greater than 180 degrees) is used for varying a user interface feature control, such as volume control, light dimming control or other variable function control. Thus, shaft 104 can rotate further in the CCW direction until the drive member 108 is stopped by stop feature 130 without transferring motion on to the carrier member 110. The continued CCW rotation varies the operating feature (such as increasing volume or increasing lighting) until the stop feature 130 is hit which equates to maximum operating condition. Thus, the rotation of the knob 102 and shaft 104 (without engagement of the carrier) is the portion of rotation that controls the variable function of the user interface operating feature. The carrier pin 146 remains engaged in the top lever recess 152 throughout operation.

Rotation in a second direction, in this view the clockwise (CW) direction, varies the operating feature in an opposite manner, such as decreasing volume or dimming lighting, until the switch is turned from ON to OFF with a single click. From the maximum volume condition, clockwise rotation of shaft 104 decreases volume until the drive pin 134 of drive member 108 engages back into the bottom lever recess 154 (at about an angle of 40 degrees). After this event, further CW rotation of shaft 104 (for example between 40 degrees to 0 degrees) is transferred to the carrier member 110 through lever 116. The carrier member 110 transfers motion to the plurality of frictional elements 112, such that the frictional elements travel simultaneously from one detent to the next in the CW direction until drive member 108 is stopped by the other side of stop feature 130, generating another single click to indicate a change from ON to OFF.

Figure 5A:
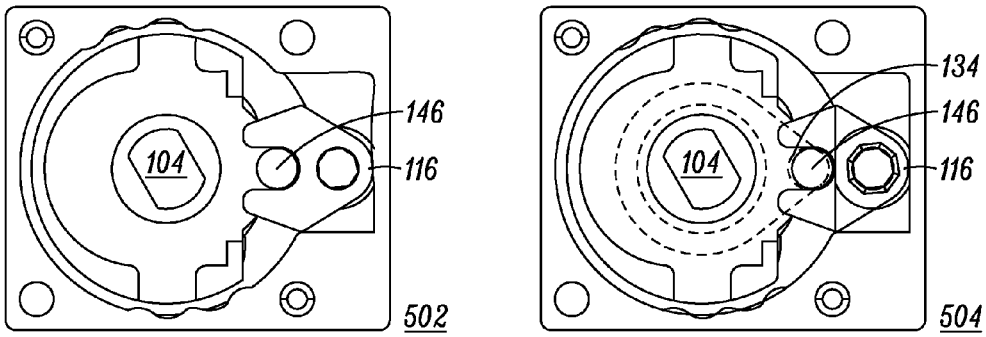
FIGS. 5A-5F illustrate rotation of the drive pin from zero to greater than 180 degrees in accordance with the various embodiments.
Figure 5B:
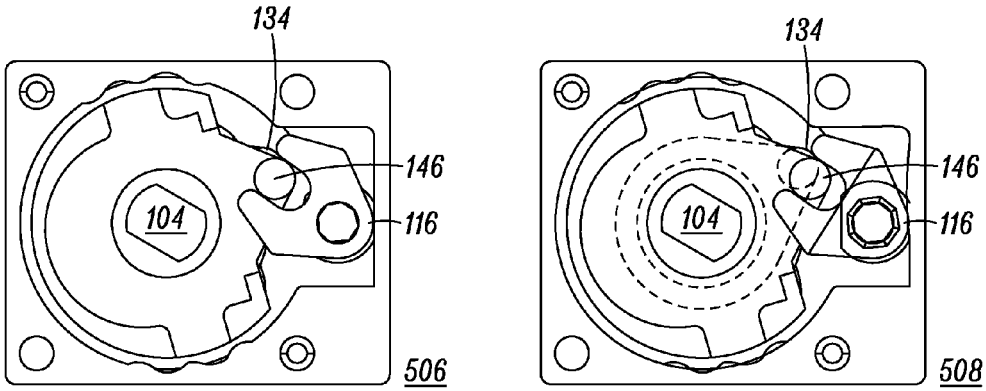
Figure 5C:
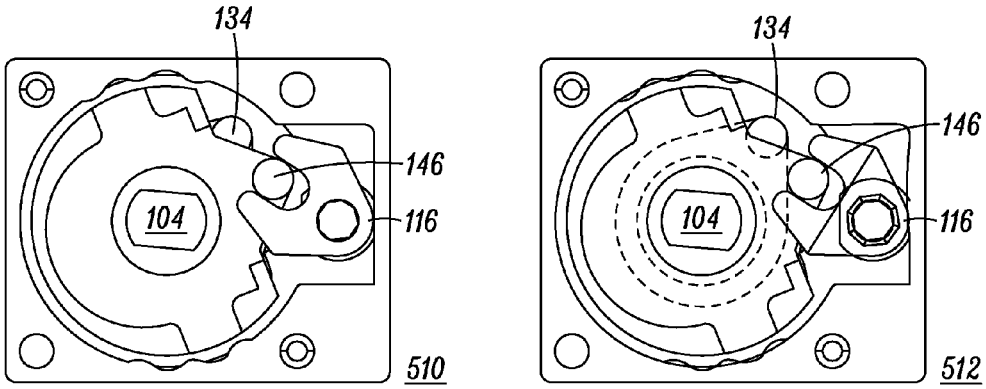
Figure 5D:
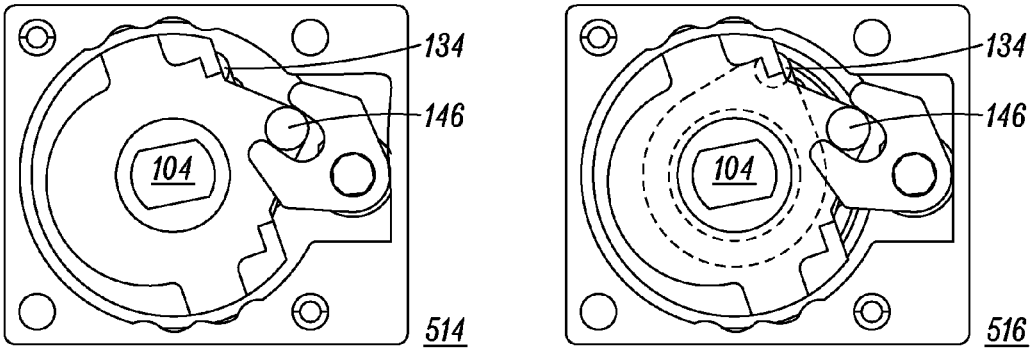
Figure 5E:
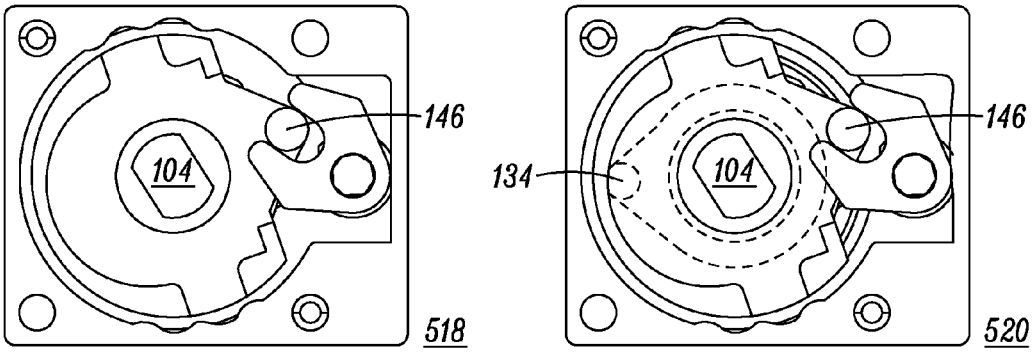
Figure 5F:
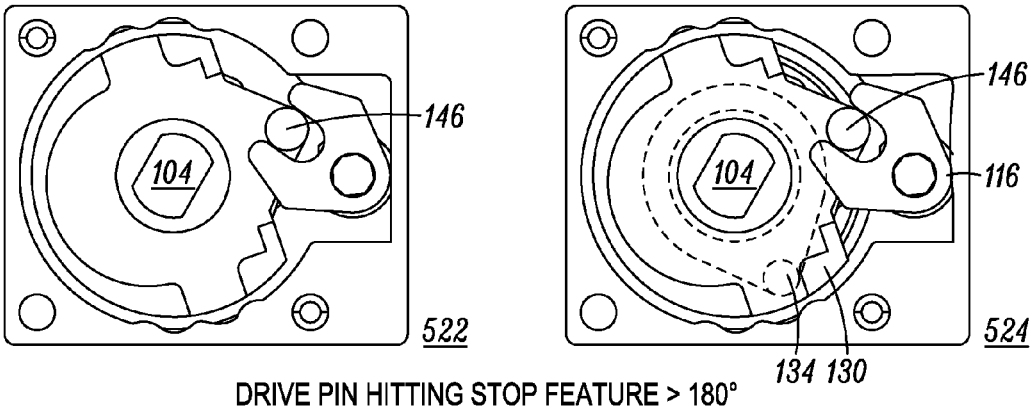

FIGS. 5A-5F, illustrate rotation of the drive pin 134 in accordance with the embodiments. FIG. 5A shows a solid view 502 and a transparent view 504 in which the drive pin 134 is coupled to lever 116, at a zero degree angle of rotation. FIG. 5B shows solid 506 and transparent 508 views in which the drive pin 134 is decoupling from the lever 116, at a predetermined angle of rotation, for example a 40 degree angle of rotation. FIG. 5C shows solid 510 and transparent 512 views in which the drive pin 134 is completely decoupled from the lever 116, at an angle greater than 40 degrees. FIG. 5D shows solid 514 and transparent 516 views in which the drive pin 134 is further rotated away from lever 116. FIG. 5E shows solid 518 and transparent 520 views in which the drive pin 134 is further rotated away from the lever 116, at an angle of approximately 180 degrees. FIG. 5F shows solid 522 and transparent 524 views in which the drive pin 134 is rotated to an angle of greater than 180 degrees, upon hitting the stop feature 130.

Hence, in accordance with the first embodiment, rotary on/off control switch 100 generates one click from OFF to ON and another click from ON to OFF. Both clicks are generated by the same frictional element and detent pair. The use of at least two frictional elements and corresponding detents provides increased torque for the single click. All frictional elements operate simultaneously, so as to generate only one click in each rotation direction.

Figure 6:
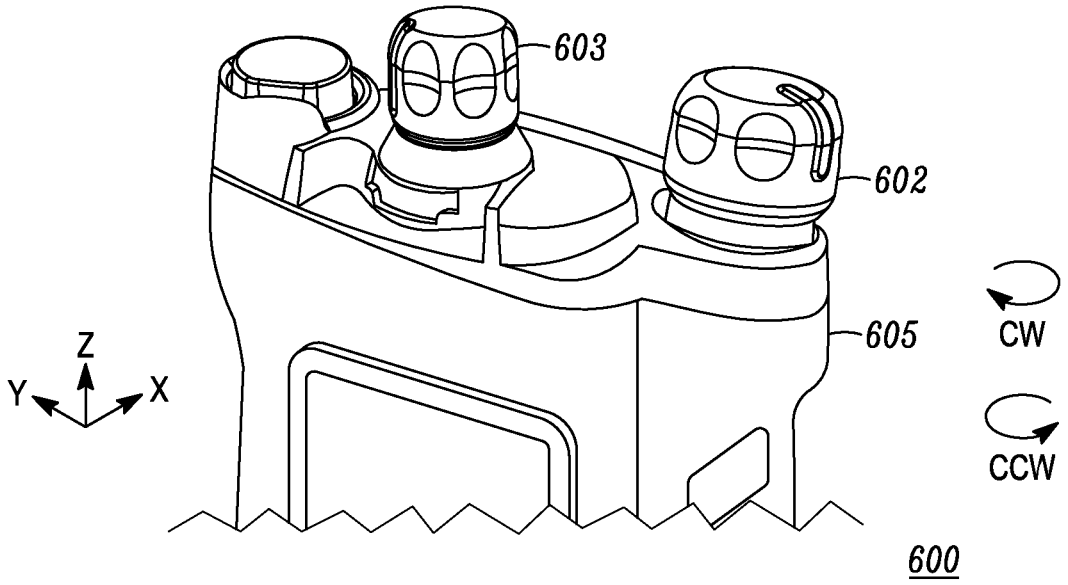
FIG. 6 is a radio incorporating the rotary on-off control switch in accordance with the various embodiments.

FIG. 6 is a communication device 600, such as a portable handheld radio, incorporating the rotary on/off switch formed in accordance with the embodiments of this application. Communication device 600 comprises a housing 605 and control knobs, 602, 603 coupled thereto. The orientation of the knob is opposite of that shown in FIG. 1 and as such rotation in a first direction generates clockwise (CW) rotation for turning the radio from OFF to ON and increasing volume, and the rotation in a second rotation provides counter clockwise rotation for decreasing the volume until the switch is turned from ON to OFF. Control knobs 602, 603 provide a user interface for radio functions such as volume control and channel selection. While control knob 602 is shown as an angled control knob, a straight control knob may also be used. The angled control knob is advantageous in public safety applications in that the knob can be easily located under visually constrained conditions as well as providing an increased clearance area to accommodate a gloved user during handheld operation.

Rotary on/off control switch 100 (or other embodiments 600, 900 to be described later) can be implemented within control knob 602. In operation, knob 602 is rotated in a clockwise (CW) direction to turn the radio from OFF to ON which generates a single click. The knob 602 can be further rotated to increase the volume over a predetermined rotation range greater than 180 degrees in the manner provided by the various embodiments. Maximum volume is reached when, referring back to the first embodiment, the drive member 108 hits stop feature 130. To decrease the volume, knob 602 is rotated in a counter clockwise (CCW) direction and upon hitting stop feature 130 in the opposite direction, the radio turns off with a single click. The single click tactile feedback provides significant advantages in the public safety environment. The increased torque provided the simultaneous rotation of the plurality of frictional elements against the plurality of detents enhances tactile feedback thereby improving the user interface. The increased torque also increases operation robustness particularly useful under adverse environmental conditions.

While some examples have been described in terms of clockwise and counter clockwise rotation, the various elements can be configured for opposite rotation as well. The rotary switch provided by the various embodiments operates based on a transfer of motion between the members. Accordingly, the shaft, the drive member, the carrier member and the lever are rotatably coupled within the casing such that rotation of the shaft causes rotation of the drive member, rotation of the drive member transfers motion to the lever, and the lever transfers motion to the carrier member over a predetermined range of rotation within which the frictional elements travel across the detents thereby generating a single click with torque for on/off.

The carrier member rotation decouples from rotation of the shaft and drive member at a predetermined angle. The carrier member remains stationary while the drive member (via the shaft) rotates alone during variable function control of the switch, such as volume up/down or dimming.

Figure 7:
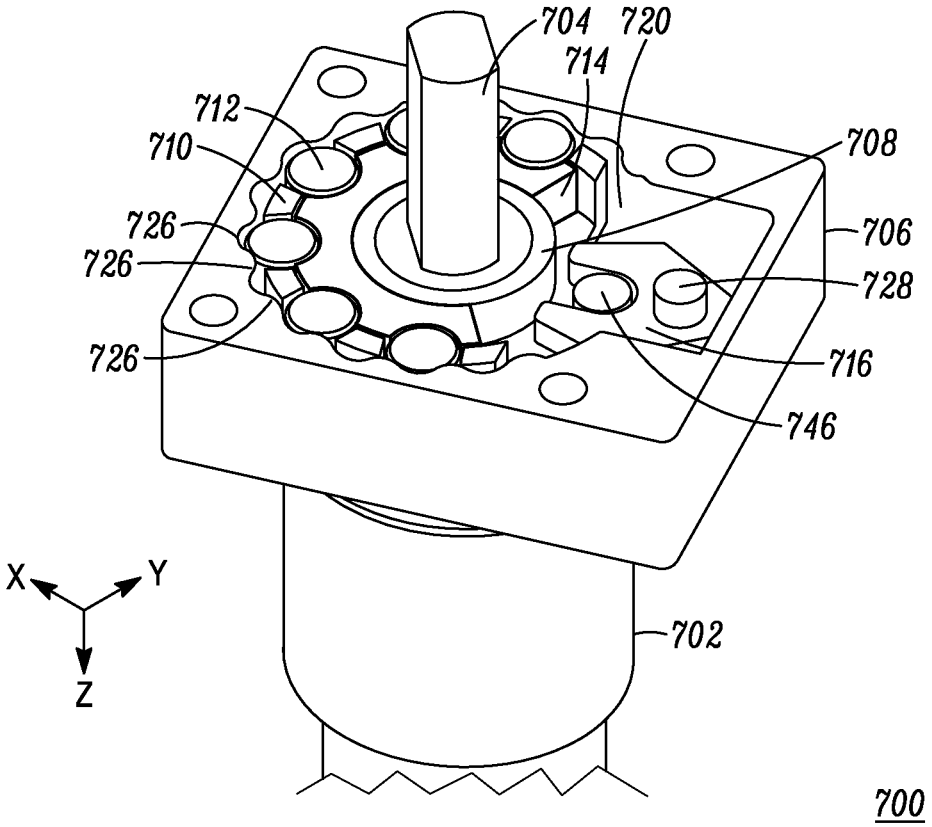
FIG. 7 is a rotary on/off control switch in accordance with a second embodiment.
Figure 8:
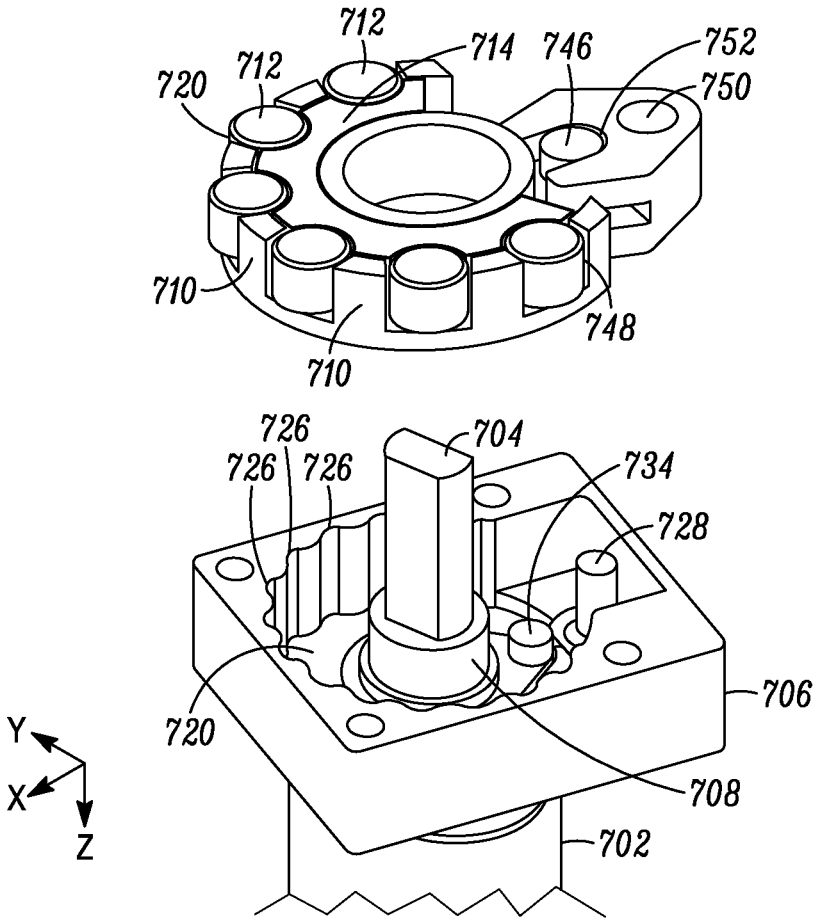
FIG. 8 is a partially exploded view of the rotary on/off control switch of FIG. 7 in accordance with the second embodiment.
Figure 9:
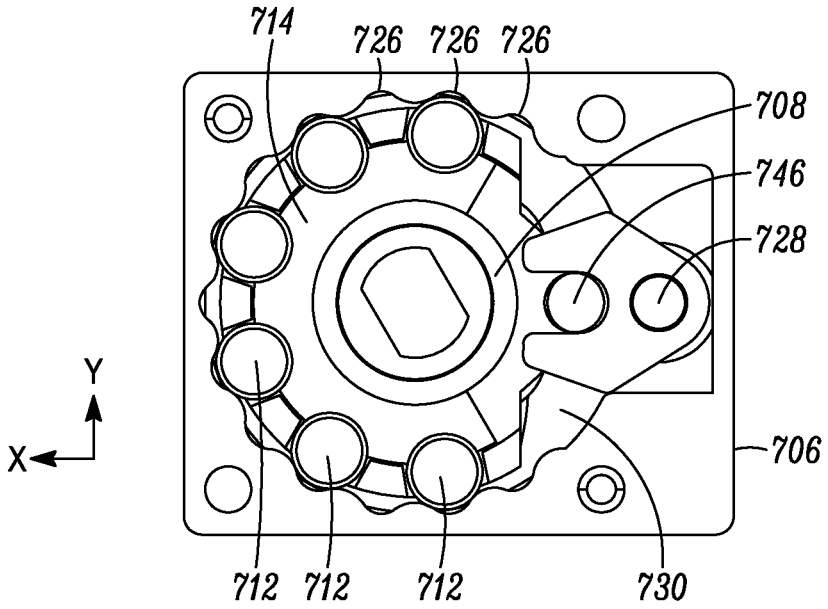
FIG. 9 is a top assembled view of the rotary on/off control switch in accordance with the second embodiment.

FIGS. 7, 8 and 9 show a rotary on/off control switch 700 in accordance with a second embodiment. FIG. 7 shows an assembled view in which the rotary on/off control switch 700 is formed of a plurality of assembly components comprising: a knob 702, a shaft 704, a casing 706, a drive member 708, a carrier member 710, a plurality of frictional elements 712, compliant member 714 and a lever 716.

In this second embodiment, the number of frictional elements 712 has been increased to provide additional torque while still generating single click operation. Carrier member 710 and casing 706 have been modified to accommodate the increased number of frictional elements 712 and corresponding increased number of detent features 726 along recessed area 720. The compliant member 714 is formed of rubber material, or other suitable material, to provide additional force by compressibly coupling the plurality of frictional elements 712 towards detent features 726. As in the previous embodiment, the compliant member 714 may be formed as a u-shaped member, however in this second embodiment, the compliant member 714 is further formed of cut-away sections to accommodate each frictional element 712, such that each frictional element is pushed against the casing wall between a pair of detents. The casing 706 further comprises a stop feature 730 (shown in other views). The casing detent features 726 align with the frictional elements 712 situated within corresponding carrier recessed openings 748. As knob 702 turns shaft 104, drive member 708 rotates lever 716 which rotates carrier member 710. The plurality of frictional elements 112 translates motion to the carrier member 710, and the frictional elements move from one detent to the next detent simultaneously across the plurality of detents 726 resulting in one click with increased torque.

FIG. 8 shows a partially exploded view in which the carrier member 710 has a frictional element 712 seated within each of the carrier recessed areas 720 The casing 706 includes detent features 726 formed along the side walls. The drive pin 734 of drive member 708 is also visible in this view.

FIG. 9 shows a top assembled view of the rotary on/off control switch 700. The plurality of frictional elements 712 are compressibly rotated simultaneously against the frictional surface provided by the corresponding detent features 726 over the initial predetermined range of shaft rotation, as provided in the original embodiment. Continuing rotation of the shaft 104 decouples the shaft 104 rotations from carrier member 710, and as such, the plurality of frictional elements 712 seated within the recessed carrier openings 748 remains stationary. The shaft 704 and drive member 708 can continue rotating, without transferring motion on to the carrier member 710, over the remaining range of rotation until drive member 708 is stopped by stop feature 730.

Reversing the motion, the shaft 704 can be rotated away from the stop feature 730 which rotates the drive member 708, without transferring motion on to the carrier member 710. Upon reaching the predetermined angle of rotation, the drive member 708 re-engages with the lever 716 which in turn rotates the carrier member 710. Rotation of the carrier member 710 compressibly rotates the frictional elements 712 simultaneously against the frictional surface provided by the corresponding detent features 726 generating a single click within the initial predetermined range upon hitting the stop feature 730 in the opposite direction.

Operationally, the rotary on/off control switch 700 operates in the same manner as the rotary on/off control switch 100 of the first embodiment. Additional torque can thus be accomplished by increasing the number of frictional elements and utilizing a compliant member 714 and carrier member 710 modified to accommodate the increased number of frictional elements, as provided by the second embodiment in FIGS. 7-9.

Figure 10:
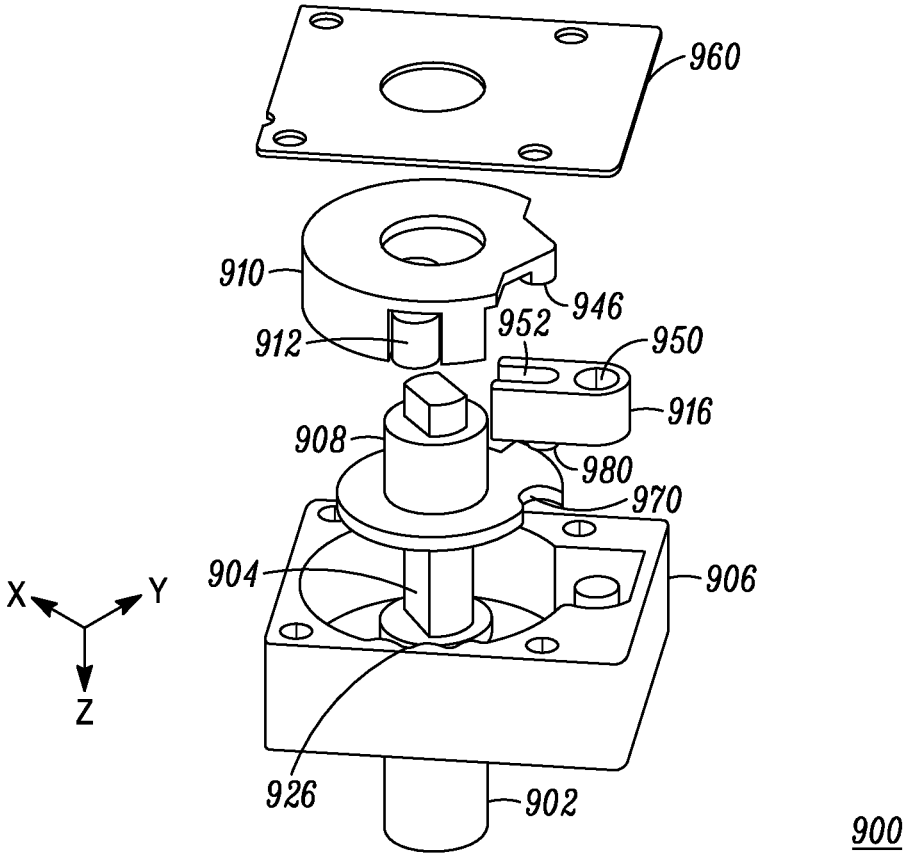
FIG. 10 is a first exploded view of a rotary on/off control switch in accordance with a third alternative embodiment.
Figure 11:
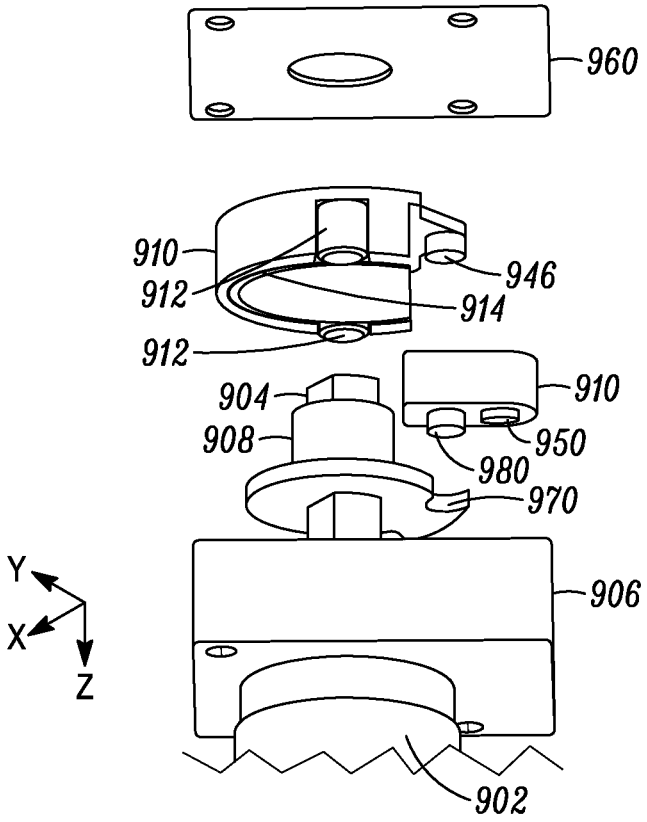
FIG. 11 is a second exploded view of the rotary on/off control switch in accordance with the third embodiment.
Figure 12:
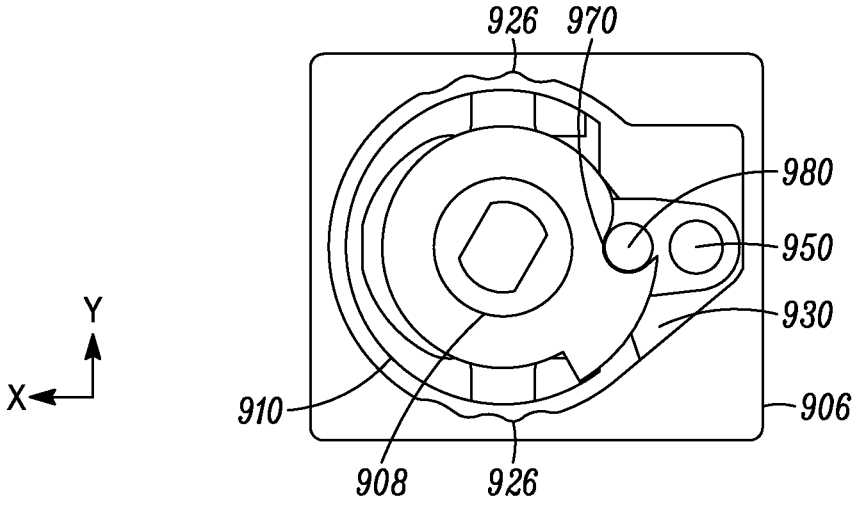
FIG. 12 is a partially assembled bottom view of the rotary on/off control switch in accordance with the third embodiment.

FIGS. 10, 11 and 12 show a rotary on/off control switch 900 in accordance with a third embodiment. FIGS. 10 and 11 show exploded views in which the rotary on/off control switch 900 comprises a knob 902, a shaft 904, a casing 906, a drive member 908, a carrier member 910, a plurality of frictional elements 912, and a lever 916. In this embodiment, the drive pin from the previous embodiments has been implemented as a hook feature 970. The lever 916 now comprises a lever pin 980 and single recess 952 with which rotate the carrier pin 946. In this embodiment, the drive member 908 uses driver hook feature 970 to hook the lever pin 980, while the carrier pin 946 remains engaged in lever recess 952. A base plate 960 is used for enclosing the casing 906, except for part of the drive member 908 and shaft 104 extending therethrough. FIG. 12 shows a top view of the drive member inserted within carrier member 910.

The driver hook feature 970 is used to rotate the carrier member 910 through a predetermined range of rotation in the manner previously described. As the knob 902 is rotated, the knob rotates shaft 104, which rotates drive member 908. Driver hook feature 970 acts as a cam and transfers motion to the lever pin 980, rotating lever 916. As lever 916 rotates, the lever recess 952 transfers motion to carrier pin 946 thereby rotating carrier member 910. A single click is generated by frictional elements 912 as the frictional elements simultaneously roll over their corresponding detents within an initial predetermined range of rotation. As such, improved torque with single click operation are provided as the rotary switch turn ON.

After the drive member 908 has rotated through a predetermined angled of rotation as set by the cam, lever 916 ceases to rotate with drive member 908, thereby decoupling the carrier member 910 from the shaft 904. Thus, shaft 904 can continue to rotate further, over a range greater than 180 degrees, until the drive member 108 is stopped by stop feature 930 without transferring motion on to the carrier. The carrier pin 946 remains engaged in the lever recess 952 on lever 916 throughout operation. Reverse sequence of operation occurs for CW rotation of the shaft 104, thereby providing a single click operation with improved torque as the rotary switch is rotated OFF.

In all of the various embodiments, the rotary switch provides greater than 180 degrees of rotation and increased on/off torque with single click operation. In response to the shaft being rotated in a first direction, the shaft turns the drive member, the drive member turns the lever, and the lever turns the carrier. A single click is generated within a predetermined range of rotation, for example between 0 to 40 degrees of rotation of the shaft. The drive member then decouples from the lever at a predetermined angle, for example at an angle of 40 degrees. The drive member is then further rotated away from the lever until reaching the stop feature of the casing. In response to the shaft being rotated in a second direction, the drive member rotates back towards the lever and couples to the carrier pin at the predetermined angle of rotation, at for example an angle 40 degrees. The lever translates motion to the carrier until the drive member motion is restricted by the stop feature in the opposite direction. The single click is generated within the predetermined range of rotation, for example from 40 to 0 degree rotation of the shaft. In all of the embodiments, the carrier remains engaged in the lever throughout all rotation. Again, single click with increased torque has been provided by all the various embodiments.

Accordingly, there has been provided an improved rotary on/off control switch assembly. The rotary on/off switch provides increased torque while maintaining single click operation for improved tactile feedback with greater than 180 degree rotation, which is of particular importance in public safety applications. Additional torque can further be achieved by increasing the number of frictional elements and corresponding recessed portions within the carrier in conjunction with corresponding detents in the casing. The various embodiments provide for a balanced design with increased torque and single click operation. When implemented as part of a rotary on/off volume control switch, the increased torque provides an improved tactile feedback, particularly beneficial for gloved users working under adverse environmental conditions.

While the various embodiments have been described in terms of volume control and light dimming, it should be appreciated that the rotary control on/off switch can also be used for other functions where the switch controls a variable impedance to adjust a user interface feature. While particularly advantageous for portable public safety type devices, the rotary control switch may also be applied to mobile and vehicular type electronic devices, as well as stationary devices. The switch may be utilized in applications operating under DC or AC power.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A rotary on/off control switch, comprising:
- a casing;
- a shaft providing greater than 180 degrees of rotation;
- a drive member coupled to the shaft;
- a carrier member having a plurality of frictional elements coupled thereto;
- a lever coupled to the carrier member and detachably coupled to the drive member;
- and
- the shaft, the drive member, the carrier member and the lever rotatably coupled within the casing such that rotation of the shaft causes rotation of the drive member, rotation of the drive member transfers motion to the lever, and the lever transfers motion to the carrier member over a predetermined range of rotation of the shaft within which the plurality of frictional elements travel against the casing thereby generating a single click with torque for on/off operation, and further rotation of the shaft beyond the predetermined range rotatably decouples rotation of the drive member and the shaft from rotation of the lever and the carrier member.

2. The rotary on/off control switch of claim 1, wherein rotation of the shaft and drive member in a first direction, beyond the predetermined range of rotation, decouples rotation of the carrier member from rotation of the shaft and drive member, such that the carrier member remains stationary throughout the further rotation of the shaft in the first direction.

3. The rotary on/off control switch of claim 2, wherein the carrier member remains stationary during rotation in a second direction until the shaft returns to within the predetermined range of rotation.

4. The rotary on/off control switch of claim 1, wherein the casing has a stop feature formed therein, the stop feature stopping rotation of the shaft at an angle of zero degrees and at an angle greater than 180 degrees.

5. The rotary on/off control switch of claim 1, wherein the shaft is fit within an aperture of the drive member within a predetermined rotational clearance.

6. A rotary on/off control switch, comprising:
- a knob having a shaft extending therethrough, the shaft providing a rotation range greater than 180 degrees;
- a casing coupled to the knob through the shaft, the casing including a recessed area, the recessed area having:
  - a stop feature integrated along a bottom surface of the casing; and
  - a bushing pin integrated on the bottom surface of the casing;
- a drive member seated within the recessed area of the casing, the drive member comprising an aperture through which the shaft extends and via which the drive member is rotatably coupled to the shaft;
- a carrier member having a carrier pin, an aperture, and a plurality of frictional elements coupled thereto, the shaft extending through the aperture;
- a lever, coupled to the carrier member and detachably coupled to the drive member, and seated within the recessed area, the lever comprising:
  - a lever hole through which the bushing pin of the casing emerges;
  - the lever being rotated and causing the carrier member to rotate in response to the shaft and drive member being rotated within a predetermined range of rotation, and further rotation of the shaft and drive member beyond the predetermined range rotatably decouples rotation of the drive member and the shaft from rotation of the lever and the carrier member.

7. The rotary on/off control switch of claim 6, wherein:
- rotation of the shaft, drive member, lever and carrier member causes the plurality of frictional elements to simultaneously rotate against the casing for single click on/off operation with torque; and
- rotation of the shaft and drive member alone provides variable function control.

8. The rotary on/off control switch of claim 6, wherein the drive member comprises a drive pin or a drive hook for engaging the lever in response to rotation of the shaft and drive member within the predetermined range of rotation.

9. The rotary on/off control switch of claim 6, wherein the plurality of frictional elements coupled to the carrier member remain stationary throughout further rotation of the shaft and drive member beyond the predetermined range of rotation as a result of the carrier member being rotatably decoupled from rotation of the shaft and drive member.

10. The rotary on/off control switch of claim 6, wherein the shaft is fit within the aperture of the drive member within a predetermined rotational clearance.

11. A communication device, comprising:
- a housing:
- a rotary on/off control switch coupled to the housing;

a knob coupled to the housing for controlling the rotary on/off control switch, the rotary on/off control switch comprising:

a casing;

a shaft rotating in response to rotation of the knob, the shaft having a range of rotation greater than 180 degrees;

a drive member coupled to the shaft, wherein the drive member rotates in response to rotation of the shaft;

a carrier member coupled to the drive member;

a plurality of frictional elements coupled to the carrier member;

a lever coupled to the carrier member and detachably coupled to the drive member, wherein the lever rotates in response to rotation of the shaft and drive member and causes the carrier member to rotate within a predetermined range of rotation, and further rotation of the drive member beyond the predetermined range rotatably decouples rotation of the drive member and the shaft from rotation of the lever and the carrier member; and the shaft, drive member and carrier member are operationally engaged to cause simultaneous rotation and friction of the plurality of frictional elements against the casing within the predetermined range of rotation thereby generating single click ON/OFF operation with torque.

12. The communication device of claim 11, wherein in response to the shaft and drive member being rotated within the predetermined range of rotation in a first direction, the shaft transfers motion to the drive member, the drive member transfers motion to the lever, and the lever transfers motion to the carrier member thereby causing the simultaneous rotation and friction of the plurality of frictional elements against the casing thereby generating single click ON operation with torque.

13. The communication device of claim 12, wherein:

continued rotation of the shaft and drive member in the first direction beyond the predetermined range of rotation decouples the drive member and the shaft from the lever and the carrier member and causes the carrier member and the plurality of frictional elements to remain stationary throughout the continued rotation.

14. The communication device of claim 13, wherein:

rotation of the shaft and drive member within the predetermined range of rotation in a second direction opposite the first direction causes the simultaneous rotation and friction of the plurality of frictional elements against the casing in the second direction thereby generating single click OFF operation with torque.

15. The communication device of claim 11, wherein the drive member comprises a drive pin or a hook for engaging and disengaging the lever.

16. The communication device of claim 11, further comprising:

a stop feature for setting the range of rotation greater than 180 degrees; and rotation of the drive member being restricted by the stop feature in two directions.

17. The communication device of claim 11, wherein the rotary on/off control switch of the communication device provides variable function control beyond the predetermined range of rotation comprising one of: volume control or lighting control.

18. The rotary on/off control switch of claim 1, wherein the lever has an axis of rotation that is offset from the drive member axis of rotation and carrier axis of rotation.

19. The rotary on/off control switch of claim 18, wherein the drive member, carrier member, and shaft share the same axis of rotation.

20. The communication device of claim 11, wherein the lever has an axis of rotation that is offset from the drive member axis of rotation and carrier axis of rotation.

21. The communication device of claim 20, wherein the drive member, carrier member, and shaft share the same axis of rotation.

* * * * *